US005361834A

United States Patent [19]

Cox

[11] Patent Number: 5,361,834

[45] Date of Patent: Nov. 8, 1994

[54] HYDRAULIC RELEASE APPARATUS AND METHOD FOR RETRIEVING A STUCK DOWNHOLE TOOL AND MOVING A DOWNHOLE TOOL LONGITUDINALLY

[75] Inventor: Don C. Cox, Roanoke, Tex.

[73] Assignee: Halliburton Company, Houston, Tex.

[21] Appl. No.: 116,144

[22] Filed: Sep. 2, 1993

Related U.S. Application Data

[63] Continuation-in-part of Ser. No. 940,634, Sep. 4, 1992.

[51] Int. Cl.[5] ..... E21B 33/128

[52] U.S. Cl. ..... 166/120; 166/138

[58] Field of Search ..... 166/105, 120, 125, 242, 166/51, 85

[56] References Cited

U.S. PATENT DOCUMENTS

| | | | |
|---|---|---|---|
| 4,103,739 | 8/1978 | Hall | 166/105 |
| 4,190,107 | 2/1980 | Oden et al. | 166/120 |
| 4,216,827 | 8/1980 | Crowe | 166/120 |
| 4,862,957 | 9/1989 | Scranton | 166/51 |
| 5,086,844 | 2/1992 | Mims et al. | 166/383 |
| 5,170,847 | 12/1992 | Mims et al. | 166/383 |
| 5,174,375 | 12/1992 | Mims et al. | 166/117 |

*Primary Examiner*—Ramon S. Britts
*Assistant Examiner*—Frank S. Tsay
*Attorney, Agent, or Firm*—Tracy W. Druce

[57] ABSTRACT

A hydraulic release mechanism for retrieving a stock downhole tool from a well casing having an elongated, cylindrical jack body, a piston carried in a bore in the jack body and a latching portion carried co-axially by the jack body for connecting with the stock tool. The piston is movable within the jack body under the influence of fluid pressure from a first position to a second position. The movement of the piston to a position intermediate its first and second positions causes an anchor slip member to ramp over a wedge member and expand radially outward against the well casing to restrain further longitudinal movement of the piston in the casing. A shearable element prevents relative motion between the anchor slip member and the jack body until the anchor slip member is moved radially outward against the well casing. The shearable element shears and releases the jack body for longitudinal motion in the casing relative to the piston when the anchor slip member is expanded radially outward against the casing, locking the piston in place. The latching portion is operatively engageable with the tool in a manner permitting the stuck tool to be lifted loose when the jack body is moved longitudinally relative to the locked piston under the influence of hydraulic pressure until the locked piston assumes its second position in the jack body.

23 Claims, 5 Drawing Sheets

HYDRAULIC RELEASE APPARATUS AND METHOD FOR RETRIEVING A STUCK DOWNHOLE TOOL AND MOVING A DOWNHOLE TOOL LONGITUDINALLY

CROSS REFERENCE TO RELATED APPLICATION

This application is a continuation-in-part of copending U.S. application Ser. No. 07/940,634 filed on Sep. 4, 1992.

BACKGROUND OF THE INVENTION

1. Field of the Invention

This invention relates to cable or reeled tubing-deployed pumping systems for use in oil and gas wells, and more particularly, to an emergency hydraulic release for the locking module discharge head in a cable-deployed or reeled tubing-deployed pumping system. A further embodiment of the invention relates to cable or reeled tubing hydraulic release apparatus for loosening a stuck downhole tool from a well casing for subsequent retrieval, or moving a downhole tool longitudinally to perform an operation in the well.

2. Description of the Background

Artificial lift systems for use in oil and gas wells are well known. One type of artificial lift system is a cable deployed pumping system as previously disclosed, for example, in U.S. Pat. No. 4,913,239. The cable-deployed pumping system allows electric submersible pumps to be installed and retrieved by means of a crush-resistant electrical cable that can be field-spliced and is designed to withstand the gripping forces of an injector and the rigors of downhole service. This is a cost-effective alternative to conventional tubing deployment and offers faster installation and retrieval with smaller equipment and few personnel.

In a standard installation for a cable-deployed pumping system, whether using a conventional pump or inverted pump, an electric submersible pump, motor and locking module discharge head are first connected to the electrical cable using a cable anchor assembly and an electrical penetrator assembly. The pumping system is then injected into the well through production tubing by means such as a modified reeled tubing injector. As the cable is lowered into the well, a collet latch on the locking module engages a locking module landing nipple disposed in the tubing string. After a subsurface safety valve below the landing nipple is opened by control fluid pressure exerted through a control line, the electric submersible pump can be activated to begin pumping well fluids to the surface. When it is desired to retrieve the pumping system from the well, the locking module is disengaged from the landing nipple by pulling upward on the electric cable.

In using the previously known cable-deployed pumping systems, problems have sometimes been encountered when sand bridges or other trash accumulates around the locking module, making it difficult or impossible to disengage and retrieve the system by pulling on the cable from the surface. The pulling force required to break the sand bridge may exceed the tensile strength of the CAPS cable, causing it to fail. A system is therefore needed that will facilitate the disengagement and separation of the locking module from the landing nipple to permit recovery of the locking module and the electric submersible pump.

Another similar problem which is sometimes encountered, is when sand bridges or other trash accumulates around, for example, a well tool such as a packer, packer seal unit, choke, plug or valve, which prevents normal retrieval of the tool. This may occur, for example, when a slickline or wireline unit would ordinarily be employed to retrieve the tool, but is unable to generate sufficient force to pull the tool loose, due to the trash that has accumulated around the tool. In such a situation, an expensive and time consuming fishing job may be required, which may require the use of a rig and running a string of pipe to depth to retrieve the stuck tool.

SUMMARY OF THE INVENTION

According to the present invention, apparatus is provided that comprises a release mechanism which utilizes hydraulic pressure to overcome the resistance caused by sand bridging or the like during recovery of a cable or reeled tubing-deployed pumping system. Although the release mechanism of the invention is primarily disclosed herein in relation to the preferred embodiment of a cable-deployed pumping system, it will be apparent that it can be similarly effective when used with a reeled tubing-deployed system. The apparatus of the invention is preferably adaptable for use in either conventional or inverted electric submersible pump applications.

According to one embodiment of the invention, an emergency release mechanism for the locking module discharge head of a cable or reeled tubing-deployed, submersible pumping system is provided. The release mechanism preferably comprises hydraulically actuated means for forcing the locking module discharge head away from the locking module landing nipple to permit subsequent withdrawal of the system from a well bore by pulling on thecable or reeled tubing.

According to a preferred embodiment of the invention, a mechanism for hydraulically releasing a locking module discharge head from a landing nipple is provided that comprises a coaxial support sleeve having a lower shoulder which abuts an annular no-go shoulder in the landing nipple. The support sleeve is disposed between inner and outer sleeves of the locking module discharge head, and shearable means connect the outer sleeve to the support sleeve to maintain positional alignment therebetween until activation of the release mechanism. A variable volume fluid chamber is defined by the space at the top of the support sleeve between the inner and outer sleeves. At the top of the variable volume fluid chamber is a control fluid inlet port in fluid communication with the surface. The variable volume fluid chamber is adapted to be expanded as control fluid is pressured into it from the surface, causing the inner and outer sleeves to move upward relative to the support sleeve, thereby shearing the shearable means and forcing the locking module discharge head to disengage and move away from the landing nipple.

According to another embodiment of the invention, a cable-deployed pumping system is provided that comprises a locking module discharge head having a hydraulically actuated release mechanism.

According to another embodiment of the invention, hydraulic release apparatus is provided which is useful to retrieve other stuck downhole tools. The hydraulic release apparatus includes a piston that is movable under the influence of hydraulic pressure to set an anchor slip member against the casing to prevent longitudinal movement of the piston in the casing against the application of further hydraulic pressure. After the anchor slip member is set against the casing, the jack body of the hydraulic release apparatus is released, so that application of further hydraulic pressure causes the jack body to move longitudinally in the casing, thus drawing the stuck tool upwards and freeing it from its stuck condition. In order to connect the hydraulic release apparatus to the stuck tool, an appropriate latching means is provided with the hydraulic release apparatus, which operatively latches onto the stuck tool when the hydraulic release apparatus is lowered into position. The latching means connects the stuck tool to the jack body, so that longitudinal motion of the jack body relative to the locked piston under the influence of hydraulic pressure causes the stuck tool to be lifted upward, freeing the tool from its stuck condition. Various alternative embodiments of the hydraulic release apparatus may be provided to accomplish longitudinal manipulation of other downhole tools, for example, to set a casing patch, cut tubing or cut the mandrel of a permanent packer for subsequent retrieval.

BRIEF DESCRIPTION OF THE DRAWINGS

The apparatus of the invention is further described and explained in relation to the following figures of the drawings wherein.

DETAILED DESCRIPTION OF THE PREFERRED EMBODIMENTS

Figure 1:
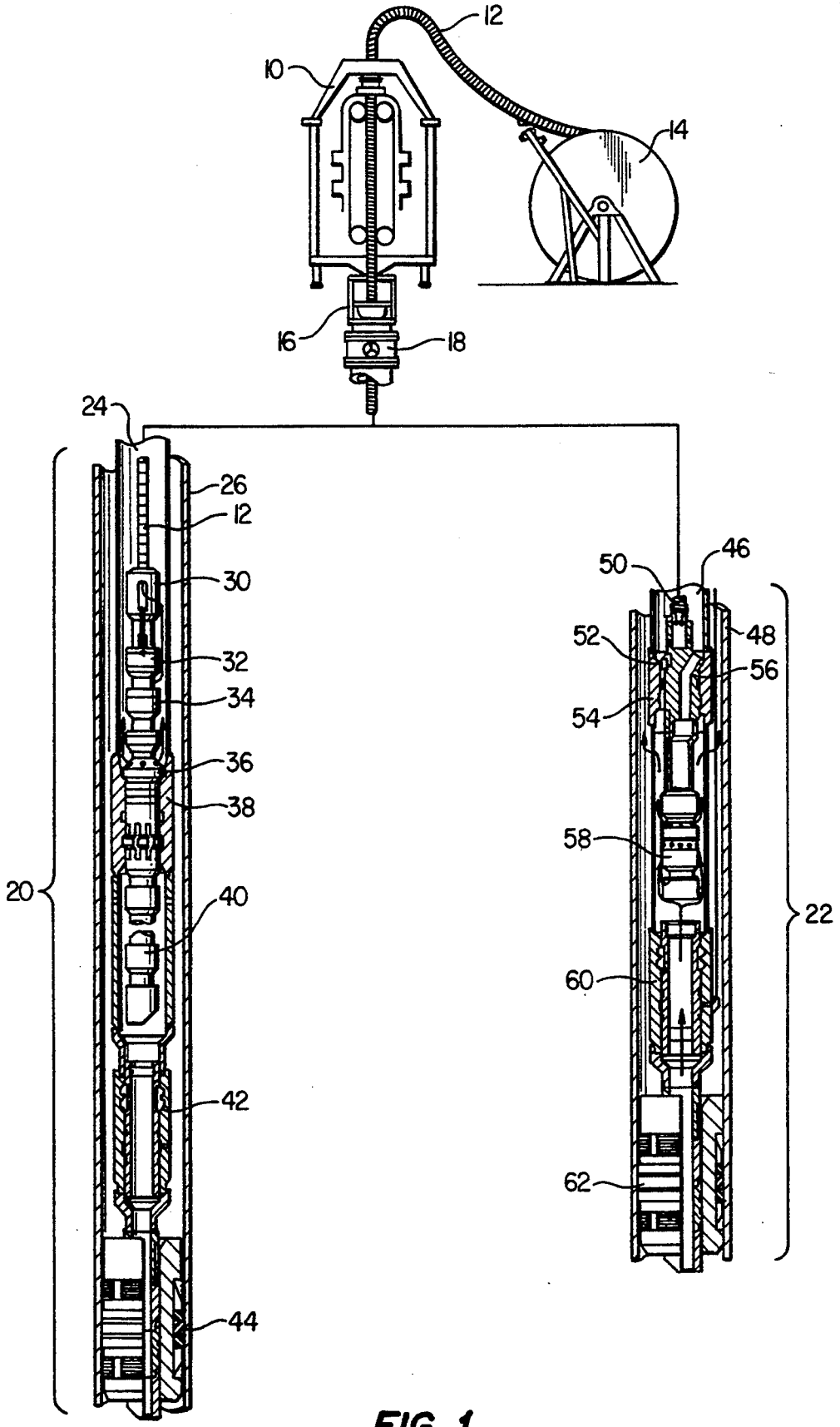
FIG. 1 is a schematic elevation view depicting a cable-deployed pumping system with alternate embodiments showing both inverted and conventional electric submersible pump installations.

FIG. 1 is a schematic drawing depicting a modified injector 10 feeding a crash-resistant electrical cable 12 from cable reel 14 through window 16 and wellhead 18 to lower either of two alternative cable-deployed pumping systems 20, 22 into a well. Pumping system 20 is a cable-deployed pumping system with an inverted pump and pumping system 22 is a cable-deployed pumping system with a conventional pump.

As shown in FIG. 1, inverted pumping system 20 is inserted through production tubing 24 disposed inside casing 26. Pumping system 20 comprises cable anchor assembly 30, electrical penetrator assembly 32, motor 34, locking module discharge head 36, locking module landing nipple 38, and electric submersible pump (ESP) 40. With the exception of hydraulic release mechanism 74, which is part of locking module discharge head 36 and is described in detail below, all other elements of pumping system 20 are previously known to those of ordinary skill in the art and are commercially available. Subsurface safety valve 42 and packer 44 are installed in production tubing 24 below pump 40.

In the other embodiment, conventional pumping system 22 is inserted through production tubing 46 disposed inside casing 48. Pumping system 22 comprises cable anchor 50, electrical penetrator 52, locking module landing nipple 54, locking module assembly 56, and conventional ESP assembly 58. Subsurface safety valve 60 and packer 62 are installed in production tubing 46 below ESP assembly 58.

Figure 2:
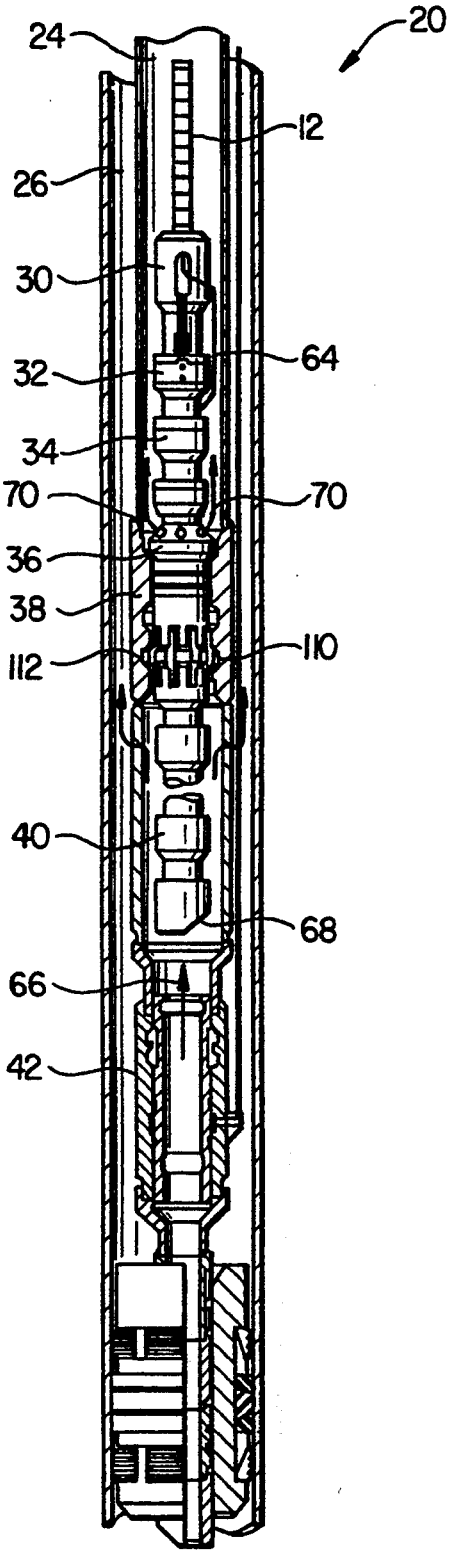
FIG. 2 is an enlarged schematic elevation view depicting the general arrangement of cable-deployed pumping system (CDPS) subsurface equipment for an inverted electric submersible pump.

Although the hydraulic release mechanism of the invention can be utilized with either cable-deployed or reeled tubing-deployed pumping systems, and with either inverted or conventional ESP systems, for purposes of illustration the preferred embodiment of the invention is described herein in relation to its use in a cable-deployed, inverted ESP system. Referring to FIG. 2, crush-resistant electrical cable 12 (such as CAPS® cable marketed by Kerite Corporation) is used to lower the subsurface equipment of pumping system 20 through production tubing 24 inside casing 26. Electrical cable 12 is a well known, commercially available product and preferably comprises a plurality of insulated electrical conductors and at least one support cable disposed inside an insulated, armored sheath. Desirably, at least one small-diameter flexible conduit 64 is also present inside electrical cable 12 to provide fluid communication between the surface and the subsurface equipment suspended from electrical cable 12. Cable anchor assembly 30 is adapted to provide a strong mechanical connection between the support cable(s) in electrical cable 12 and the other subsurface equipment of pumping system 20 that is suspended by threaded connections therefrom. Electrical penetrator assembly 32 is adapted to connect the electrical conductors passing through electrical cable 12 to motor 34.

As pumping system 20 is lowered through production tubing 24, locking module discharge head and collet latch 36 locate, contact and engage locking module landing nipple 38, thereby placing pump 40 at the desired depth in the well bore and stopping the downward travel of pumping system 20 through the tubing. When motor 34 and pump 40 are activated from the surface, production flow 66 is pulled upward through subsurface safety valve 42 into inlet port 68 of pump 40 and thereafter discharged as shown by arrows 70 upwardly through production tubing 24.

During production, sand and other fine particulate matter which is carried upward by production flow 66 through pump 40 can settle out and collect around locking module discharge head 36. Over time, this sediment can harden to form a bridge or other obstruction above locking module discharge head 36 that will impede the removal of pumping system 20 from the well. When this occurs, the lifting force required to disengage the locking module discharge head from the locking module landing nipple may exceed the rated tensile strength of electrical cable 12. The use of a locking module discharge head 36 having a hydraulic release mechanism as disclosed herein will desirably enable the operator to jack the locking module discharge head 36 away from the locking module landing nipple 38 a sufficient distance to break through the sand bridge or obstruction, after which electrical cable 12 can be withdrawn from the well to recover cable-deployed pumping system 20.

Figure 3:
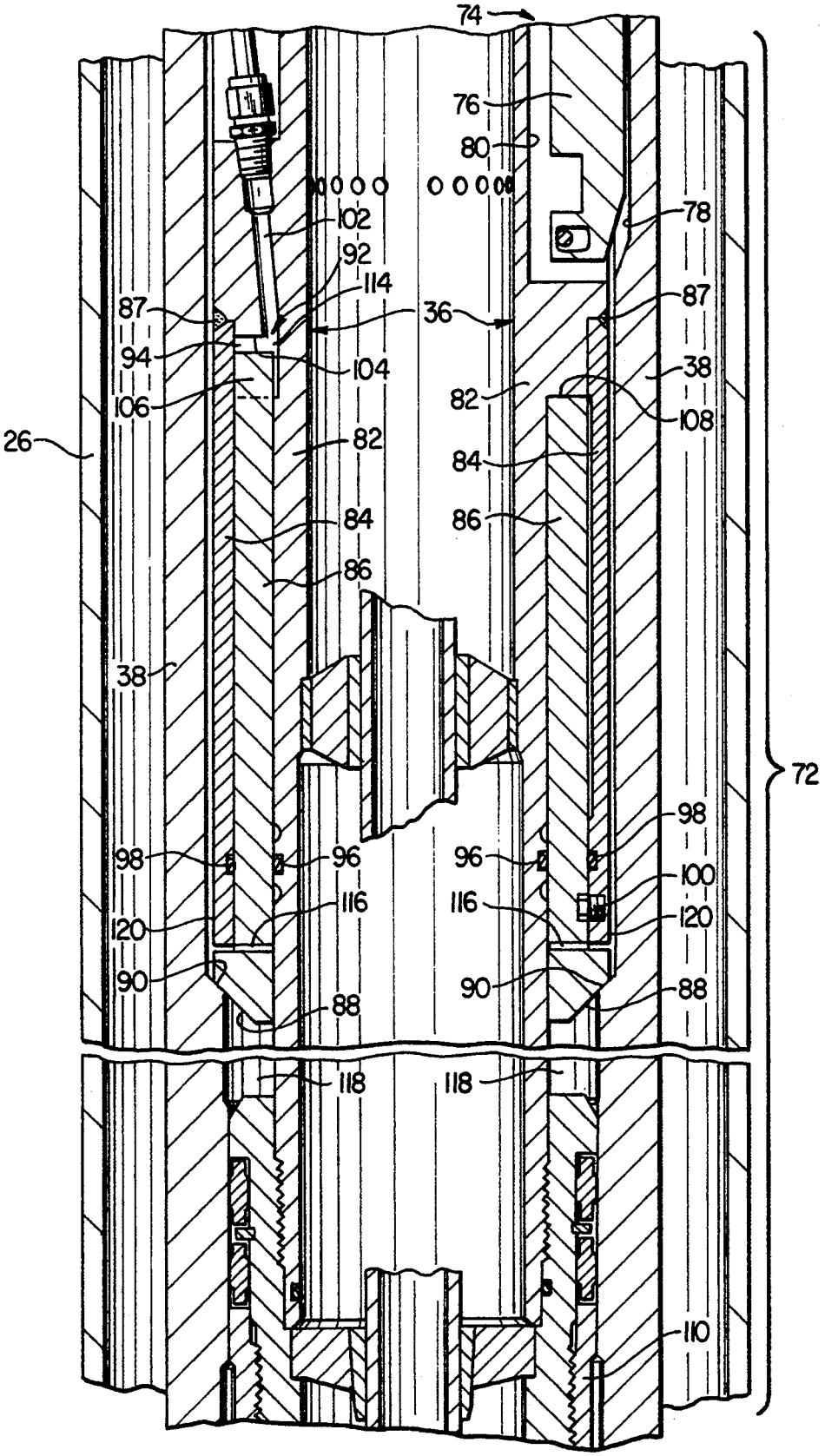
FIG. 3 is an enlarged sectional elevation view, partially broken away, depicting the hydraulic release mechanism of the present invention.

As shown in FIG. 3, section 72 is an enlarged cross-sectional elevation view (partially broken away) through that portion of production tubing 26, locking module discharge head 36 and locking module landing nipple 38 where release mechanism 74 is located. As locking module discharge head 36 is lowered into locking module landing nipple 38, lower shoulder 88 of support sleeve 86 contacts annular no-go shoulder 90, and collet latch 110 (better seen in FIG. 2) engages profile 112 in landing nipple 38. Release mechanism 74 of the invention is disposed above collet latch 110, the top of which is visible near the bottom of FIG. 3.

Referring to FIGS. 2 and 3, locking module discharge head 36 preferably comprises inner sleeve 82, outer sleeve 84 and support sleeve 86. Outer sleeve 84 is secured to inner sleeve 82 by weld 87 or other similarly effective means, and support sleeve 86 is coaxially aligned between inner sleeve 82 and outer sleeve 84 in such manner that inner sleeve 82 and outer sleeve 84 slidably engage support sleeve 86. During the installation and operation of cable-deployed pumping system 20, support sleeve 86 is preferably maintained in fixed relation to inner and outer sleeves 82, 84 by shearable means such as shear screw 100. Although only one shear screw 100 is shown in FIG. 3, it will be appreciated that a plurality of circumferentially spaced shear screws can be used. Shear screw 100 prevents inner and outer sleeves 82, 84 of locking module discharge head 36 from prematurely sliding upwards relative to support sleeve 86 where, for example, a hydrostatic head is encountered as locking module discharge head 36 is lowered into locking module landing nipple 38.

Rotational lock key 76 in recess 80 of inner sleeve 82 preferably engages recess 78 in landing nipple 38 to restrict rotational motion of locking module discharge head 36 relative to landing nipple 38 when, for example, electric submersible pump 40 (FIGS. 1 and 2) is activated. This torque limiting effect of prong 106 protects shear screw 100 from unintended rotational shearing.

Inner sleeve 82 and outer sleeve 84 cooperate with surface 94 of support sleeve 86 to define fluid chamber 92. As shown in FIG. 3, surface 94 is at the top of prong 106, which extends upwardly beyond annular top surface 108 of support sleeve 86 into slot 114 in inner sleeve 82. Slot 114 thereby helps define fluid chamber 92 and also cooperates with prong 106 to restrict rotational motion between inner sleeve 82 and support sleeve 86. Hydraulic fluid is supplied to fluid chamber 92 through inlet port 102, which preferably communicates with the surface through electrical cable 12. Inner and outer O-rings 96, 98, respectively, are preferably provided to restrict fluid bypass between the facing, longitudinally extending walls of inner and outer sleeves 82, 84 and support sleeve 86. Drilled ports 116 are preferably provided to form a fluid leak path between bore 118 and annular space 120, thereby avoiding the possibility of hydraulic lock-up.

During installation and use of pumping system 20, the volume of fluid chamber 92 remains constant because of the fixed positional relationship between inner and outer sleeves 82, 84 and support sleeve 86. Upon activation of release mechanism 74, however, pressurized hydraulic fluid is pumped from the surface through inlet port 102 into fluid chamber 92. When the pressure in fluid chamber 92 becomes sufficiently great to cause shear screw 100 to shear, inner sleeve 82 and outer sleeve 84 are forced upward relative to support sleeve 86, expanding the volume of fluid chamber 92. (Downward movement of support sleeve 86 is precluded by annular shoulder 90 of locking module landing nipple 38.) The upwardly directed force exerted on surface 104 of inner sleeve 82 from fluid chamber 92 is desirably great enough to jack inner sleeve 82 upwards relative to locking module landing nipple 38, breaking through any sand bridge or other obstruction above locking module discharge head 36 and disengaging collet latch 110 from profile 112 in locking module landing nipple 38. Pumping system 20 can then be retrieved to the surface by pulling on electrical cable 12 without fear of cable failure.

The hydraulically powered release mechanism is not limited to the application of cable deployed, electric, submersible pump assemblies that have become stuck in a landing nipple. In general, the mechanism can be adapted to any downhole situation where, for example, a retrievable packer, packer seal unit, choke, plug or valve has become stock, jammed, "sanded in" or for some reason stuck as to prevent normal retrieval, or for some other reason longitudinal manipulation of a downhole tool is required. Referring to FIGS. 4A–6B, a hydraulic release apparatus embodiment, indicated generally as 200, is shown which is suitable for retrieving a stuck downhole tool from a well casing 202. In general, hydraulic release apparatus 200 can be run into well casing 202 on coil tubing or pipe, or lowered at the end of a slickline, not shown in the FIGS. As shown in FIGS. 4A–6B, hydraulic release apparatus 200 is deployed on the end of coil tubing 204.

Generally, hydraulic release apparatus 200 includes an elongated cylindrical jack body 206, a piston 208, anchor means, illustrated generally at 210 and described hereafter, which is movable against the casing 202 to restrain longitudinal movement of piston 208 in the casing 202, and latching means, illustrated generally at 212 and described hereafter, which is operatively engageable with the downhole tool in a manner permitting the downhole tool to be moved longitudinally or manipulated by longitudinal movement of jack body 206 within the casing 202. Communication of pressurized fluid from the surface or other means to hydraulic release apparatus 200 to manipulate jack body 206, piston 208, and set anchor means 210 against casing 202 is provided via coil tubing 204, which is threadedly engaged in an axial bore 213 located in the top portion of jack body 206. As shown, pipe threads may be employed to prevent leakage between jack body 206 and coil tubing 204, although other suitable means may also be utilized to prevent leakage therebetween. In this embodiment, coil tubing 204 provides locating means for lowering and positioning hydraulic release apparatus 200 in the well casing 202 adjacent the stuck tool in a suitable position wherein latching means, described hereafter, is operatively engaged with the stuck tool for movement therewith when jack body 206 is moved longitudinally relative to piston 208 to loosen the stuck tool for subsequent retrieval from casing 202, as described hereafter.

In the unshown slickline embodiment, a control line, not shown in the FIGS., may connect to the jack body to communicate pressurized fluid to the hydraulic release apparatus. In this embodiment, the slickline provides locating means for lowering and positioning the slickline hydraulic release apparatus in the well casing adjacent the stuck tool in a suitable position wherein latching means, described hereafter, is likewise operatively engaged with the stuck tool for movement therewith when the jack body is moved longitudinally relative to the piston to loosen the stuck tool for subsequent retrieval from the casing, as described hereafter. To communicate pressurized fluid to the jack body, the control line may be threadedly engaged in a bore in the upper portion of the jack body. Pipe threads may likewise be provided to prevent leakage between the jack body and the control line. Otherwise, the slickline embodiment of the hydraulic release apparatus is similar to hydraulic release apparatus 200. In another alternative embodiment the jack body may be provided with a fluid reservoir, and an electric pump may be provided which communicates pressurized fluid from the fluid reservoir to operate the hydraulic release apparatus. A source of power to operate the electric pump may be provided by electric line or a downhole battery pack, which may be mounted on the jack body.

Figure 4A:
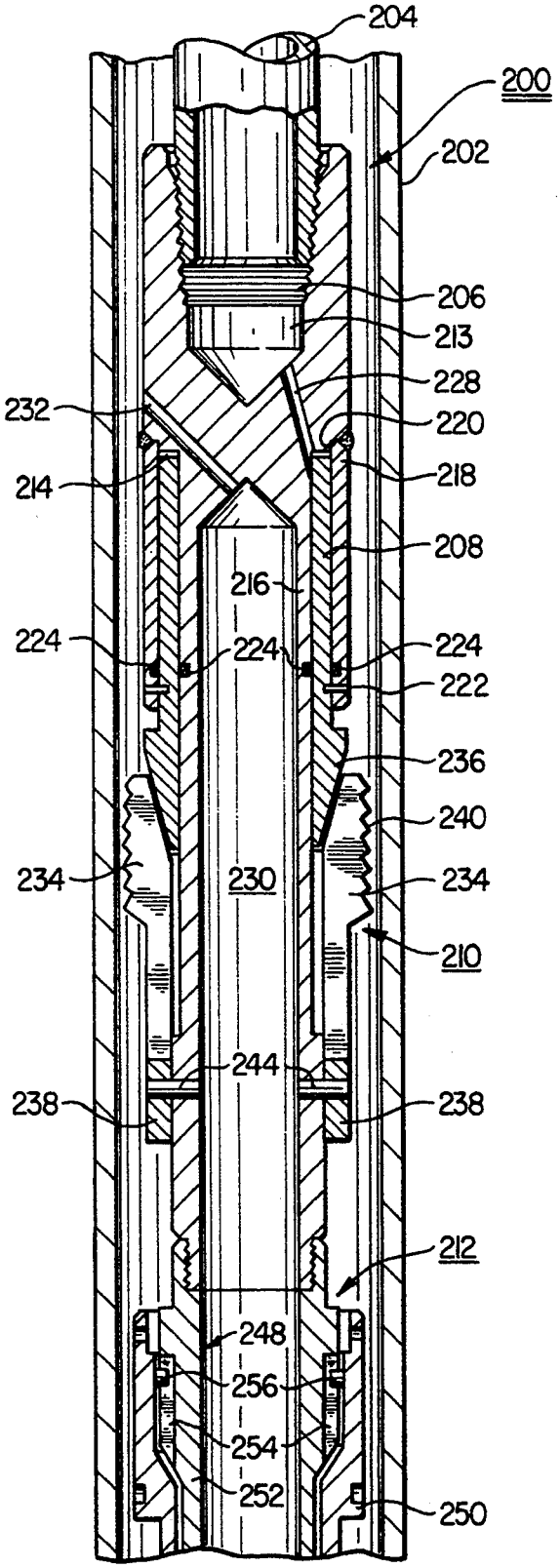
FIGS. 4A–4B is a side, sectional view of a coil tubing deployed hydraulic release apparatus embodiment suitable for retrieving a stuck downhole tool such as a packer from the well casing showing the hydraulic release apparatus in its ran-in configuration.
Figure 4B:
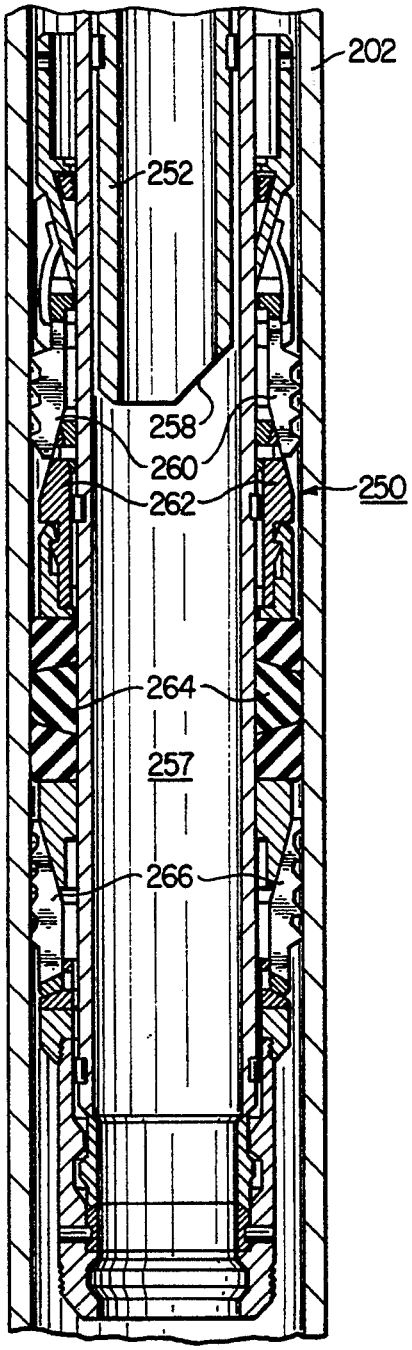

As illustrated in FIGS. 4A–4B, piston 208 may be provided in the form of a sleeve shaped member, which is received in a ring shaped, elongated bore 214 in jack body 206. As illustrated in FIG. 4A, bore 214 may be provided by forming jack body 206 with a narrowed cylindrical neck portion 216, which is concentrically received within an elongated, cylindrical sleeve 218, and radially spaced therefrom to form bore 214. Cylindrical sleeve 218 may be received in an annular recess 220 concentrically surrounding the main portion of jack body 206 at its juncture with neck portion 216, and attached thereto by suitable means such as welding or threads. A seal element, not shown in the FIGS., may be provided to prevent fluid leakage between cylindrical sleeve 218 and jack body 206.

Figure 6A:
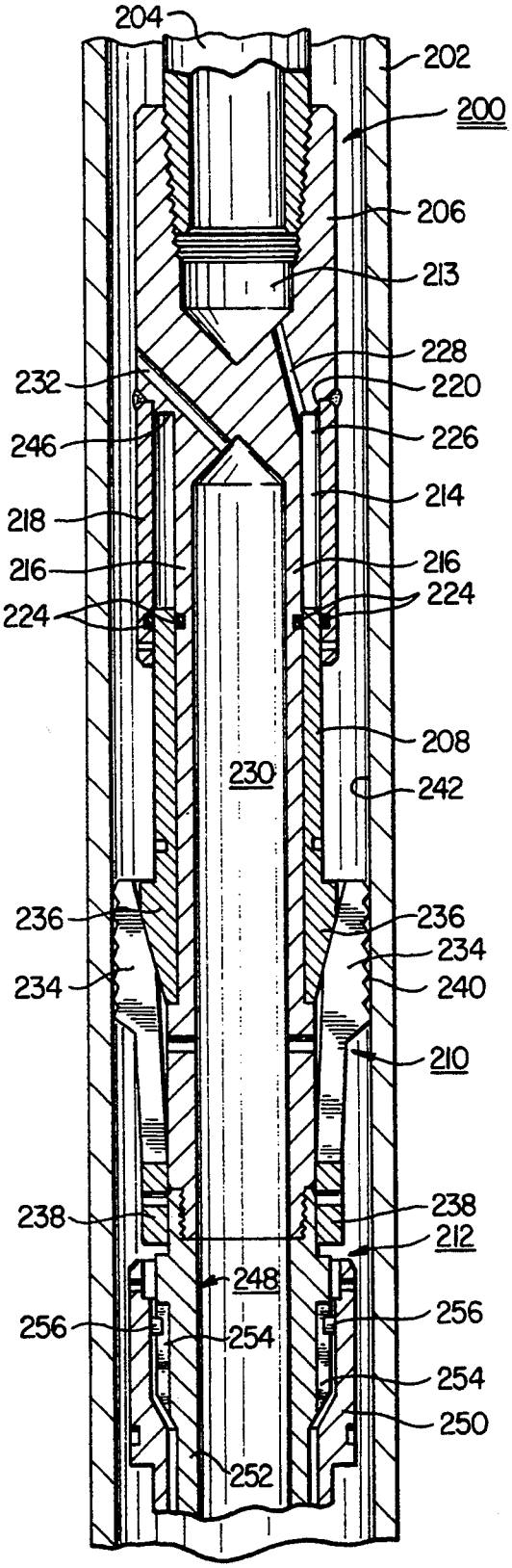
FIGS. 6A–6B is a third, side sectional view of the hydraulic release apparatus shown in FIGS. 4A–4B showing the jack body moved longitudinally up the casing relative to the piston, drawing the attached pulling device upward, releasing the packer for movement and loosening the packer from its stuck position in the casing.

Piston 208 is movable in bore 214 from a first position, as shown in FIG. 4A, to a second position in body 206, as shown in FIG. 6A. One or more shearable elements in the form of shear screws or pins 222 releasably engage piston 208 to jack body 206 until after hydraulic release apparatus 200 has reached the desired downhole location. Shear pins 222 join piston 208 and jack body 206 to retain piston 208 in its first position against inadvertent increases in fluid pressure. The predetermined value at which shear pins 222 release or shear may be, for example, 1,000 pounds-force.

A pair of annular elastomeric seals 224 carried in annular grooves on opposed surfaces of neck portion 216 and cylindrical sleeve 218 sealingly engage piston 208 and form a movable fluid barrier between cylindrical sleeve 218, piston 208 and neck portion 216. Piston 208 and elastomeric seals 224 enclose a variable volume fluid chamber 226, which is provided by the portion of bore 214 contained between piston 208, sleeve 218 and neck portion 216. As may be appreciated, the number of seal elements or other seal means between piston 208, neck portion 216 and cylindrical sleeve 218 which enclose fluid chamber 226 may number more or less.

Figure 5:
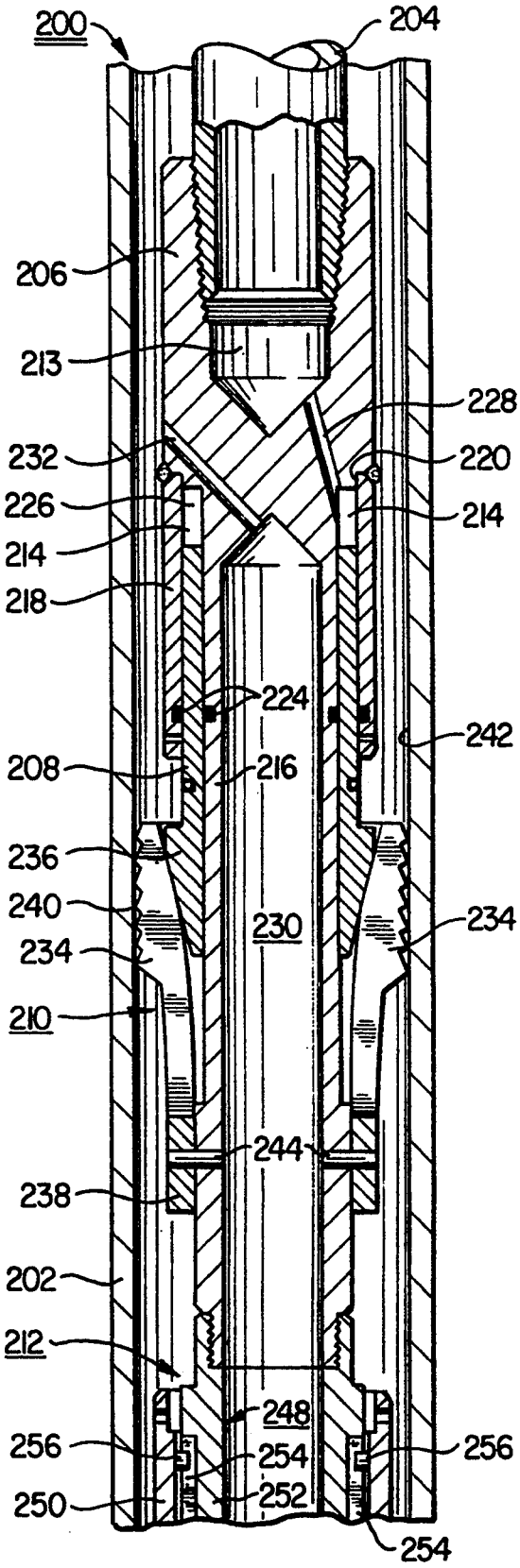
FIG. 5 is a second, side sectional view of the hydraulic release apparatus shown in FIGS. 4A–4B showing the slip assembly set against the casing to restrain longitudinal movement the piston in casing.

One or more ports 228 extend through jack body 206 and connect with bore 213 and fluid chamber 226 to communicate pressurized fluid from the interior of coil tubing 204 to fluid chamber 226 to move piston 208 to an intermediate anchored position between its first and second positions, as illustrated in FIG. 5, to set anchor means 210 against casing 202 and thereafter act against jack body 206 to move jack body 206 longitudinally in casing 202 relative to piston 208 until piston 208 assumes its second position in jack body 206, as shown in FIG. 6A. In order to prevent pressure build up in the area enclosed between latching means 212 and jack body 206, neck portion 216 may be provided with a counterbore 230 which communicates with the interior of the casing 202 via one or more ports 232 to prevent pressure buildup. In the slickline embodiment, one or more ports likewise extend through the jack body to connect with the bore in which the control line is connected and the fluid chamber to communicate pressurized fluid from the interior of the control line to the fluid chamber to move the piston to a similar intermediate position as illustrated in FIG. 5 to set anchor means 210 against the casing and thereafter act against the jack body to move the jack body longitudinally in the casing until the piston assumes it second position in the jack body, similar to FIG. 6A.

Referring to FIG. 4A, anchor means 210 may be provided in the form of an expandable C-shaped anchor slip member 234, a cylindrically shaped wedge member 236, and a cylindrically shaped slip support 238. Anchor slip member 234 is carried on neck portion 216 between wedge member 236 and slip support 238. Slip member 234 may be equipped with teeth 240 on their outer surfaces for gripping casing 202 to hold piston 208 in a fixed position thereto when set against casing 202. Alternatively, for example, slip member 234 may be segmented.

Wedge member 236 may be attached to piston 208 for movement therewith toward slip support 238, which may be attached to neck portion 216 so that anchor slip member 234 ramps over wedge member 236 from a first recessed run-in or retrocted configuration, as shown in FIG. 4A, and is expanded radially outward to a second anchored configuration suitable for gripping engagement against bore 242 of casing 202, as shown in FIG. 5. Because wedge member 236 is arranged to further wedge or ramp under complimentary shaped anchor slip member 234 under the influence of further fluid pressure applied in fluid chamber 226 against piston 208, once anchor slip member 234 is ramped outwardly against casing bore 242, piston 208 is locked in position in casing 202, and prevented from moving downward in casing 202 under the influence of further hydraulic pressure.

One or more shear pins 244 releasably engage slip support 238 to neck portion 216 of jack body 206 until anchor slip member 234 is ramped to its second position, grippingly engaged against the bore 242 of casing 202. Thereafter, at a predetermined fluid pressure, pins 244 shear, releasing jack body 206 for longitudinal motion relative to anchor slip member 234 and piston 208, which remains locked in position in casing 202 by the wedging action between anchor slip member 234 and slip support 238 under the influence of fluid pressure in fluid chamber 226 acting downward on piston 208. Once pins 244 shear, releasing jack body 206 from its juncture with piston 208, fluid pressure acting against an annular shoulder 246 on jack body 206 causes jack body 206 to move longitudinally upward in casing 202 relative to locked piston 208 and anchor slip member 234, until piston 208 assumes its second position in jack body 206, as shown in FIG. 6A. As may be appreciated a lug arrangement or complementary shoulder portions, not shown in the FIGS., may, for example, be provided to retain piston 208 in bore 214.

Referring again to FIG. 4A, latching means 212 may be provided in the form of a pulling device 248, which is suitable for pulling and releasing a downhole tool such as a retrievable packer 250 when jack body 206 is moved longitudinally upward in casing 202. Pulling device 248 includes a tubular body 252 which extends concentrically downward from neck portion 216 of jack body 206, and is attached thereto by suitable means such as threads for longitudinal motion therewith. Tubular body 252 may be provided with one or more J-shaped slots 254 therein which engage with lugs 256 on the top sub of packer 250 when hydraulic release apparatus 200 is lowered in casing 202 to depth and positioned with the lower end of tubular body 252 inserted into the bore 257 of packer 250. To aid in insertion of the lower end of tubular body 252 into bore 257 of packer 250, the lower end of tubular body 252 may have a slanted portion 258, as shown in FIG. 4B.

Figure 6B:
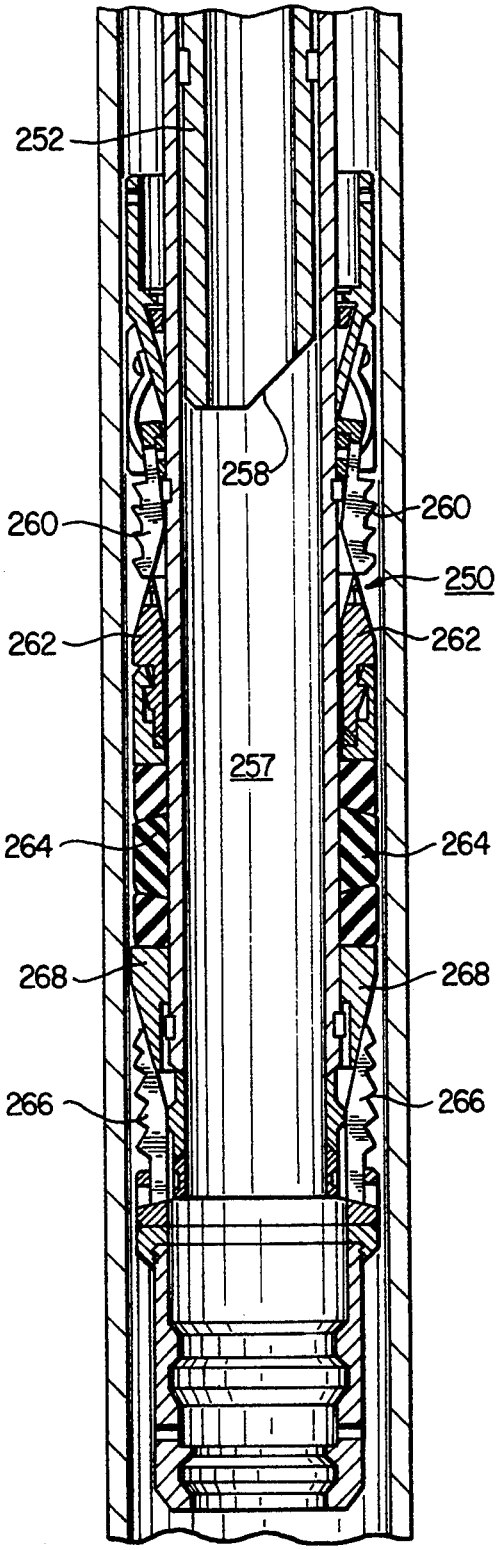

With lugs 256 engaged in J-shaped slots 254, upward motion of jack body 206 relative to piston 208 under the influence of hydraulic pressure pulls the upper end of packer 250 upward, thus freeing packer 250 from its stuck position in casing 202. Upward motion of the upper end of packer 250 pulls the packer's upper slip 260 upward and off upper ramp 262, allowing the packer seal assembly 264 to relax inward. As packer 250 moves upward in casing 202, its lower slip 266 moves downward and off lower ramp 268, as shown in FIG. 6B, thus freeing packer 250 from its set condition for subsequent retrieval from casing 202.

Latching means 212 may also be in the form of a ratcheting, latchable head, not shown in the FIGS. Conventionally, the ratcheting, latchable head may be provided with a threaded collet portion which allows the ratcheting, latchable head to ratchet downward over a threaded portion on the upper end of a downhole tool such as a retrievable packer while preventing ratcheting movement in the opposite direction, thus allowing operative engagement between the ratchcling, latchable head and the tool to permit the downhole tool to be moved longitudinally or lifted loose when jack body 206 is moved longitudinally relative to piston 208. Of course, it is also within the scope of the invention that other latching means may also be utilized to latch on to the downhole tool such that longitudinal movement of jack body 206 in casing 202 causes the downhole tool to move longitudinally or to be freed for retrieval. For example, the latching means may latch onto a casing patch, such that the casing patch can be moved longitudinally upward to set the patch, thus repairing damaged casing. In another example, the latching means may include a longitudinally movable cutting tool, which expands radially outward when moved longitudinally upward to cut a tubular member or the mandrel of a permanent packer for retrieval.

Hereafter, the operation of hydraulic release apparatus 200, coil tubing 204 and latching means in the form of pulling device 248, which is suitable for retrieving a stuck retrievable packer 250, is described. In operation, hydraulic release apparatus 200 is run into well casing 202 by unfeeling coil tubing 204, and positioned in casing 202 such that its latching means in the form of pulling device 248 operatively engages the stuck packer 250. Shear pins 222 prevent inadvertent movement of piston 208 relative to jack body 206 while hydraulic release apparatus 200 is being run into casing 202 and positioned to operatively engage packer 250. Slanted portion 258 assists in locating tubular body 252 in the entrance to bore 257 of packer 250 such that further downward movement of hydraulic release apparatus 200, and its attached pulling device 248 causes J-shaped slots 254 to engage lugs 256 on the top sub of packer 250, thus operatively attaching packer 250 to pulling device 248 for longitudinal movement therewith.

At this point, pressurized fluid applied through coil tubing 204 to fluid chamber 226 to act against piston 208, shears shear pins 222 and causes piston 208 to move downward to its intermediate position between its first and second positions, as shown in FIG. 5. As piston 208 moves downward to its intermediate position, wedge member 236 moves downward and under anchor slip member 234, causing anchor slip member 234 to ramp radially outward against bore 242 of casing 202. Continued application of hydraulic pressure causes teeth 240 to grippingly engage casing bore 242, locking piston 208 in position within casing bore 242 and restraining further longitudinal movement of piston 208 in casing 202.

Once anchor slip member 234 is set against grippingly against casing bore 242, further application of increased hydraulic pressure causes shear pins 244 to shear, releasing jack body 206 for longitudinal movement in casing 202 relative to locked piston 208 and anchor slip member 234. In order to assure that slip member 234 is set grippingly against casing 242, the predetermined value at which shear pins 244 shear or release, is such to assure that anchor slip member 234 is set grippingly against casing bore 242 to prevent slippage of anchor slip member 234 against the application of further increased hydraulic pressure necessary to free the stuck tool. Once shear pins 244 shear, further application of hydraulic pressure attempts to force piston 208 downward, which remains locked in position in casing 202 by the wedging action between anchor slip member 234 and complimentary shaped slip support 238. After shear pins 244 shear, further application of hydraulic pressure acts against shoulder 246 of jack body 206, causing jack body 206 to move longitudinally upward in casing 202 relative to locked piston 208, until piston 208 assumes its second position in jack body 206, as shown in FIG. 6A.

With lugs 256 engaged in J-shaped slots 254, upward motion of jack body 206 relative to locked piston 208 under the influence of hydraulic pressure pulls the upper end of packer 250 upward, thus freeing packer 250 from its stuck position in the sand bridge or trash which has accumulated in casing 202 adjacent the upper end of packer 250. Upward motion of the upper end of packer 250 pulls the packer's upper slip 260 upward and off upper ramp 262, allowing the packer seal assembly 264 to relax inward. As packer 250 moves upward in casing 202, freed from the sand bridge or trash which has accumulated around its upper end, its lower slip 266 moves downward and off lower ramp 268, as shown in FIG. 6B, allowing packer 250 to be moved longitudinally upward in casing 202, thus freeing packer 250 from its set condition for removal from casing 202. Thereafter, the hydraulic pressure may be released, allowing wedge member 236 to recede from under anchor slip member 234 as hydraulic release apparatus 200 is withdrawn from casing 202, allowing anchor slip member 234 to collapse radially inward. Hydraulic release apparatus 200, coil tubing 204 and packer 250 may now be removed as a unit from casing 202 by rewinding coil tubing 204.

The operation of the slickline hydraulic release apparatus is similar to the above method of operation, except that the slickline is employed to position the hydraulic release apparatus for operative engagement with the stuck tool.

Other alterations and modifications of the invention will become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A hydraulic release apparatus for moving a downhole tool longitudinally in a well casing, the release apparatus comprising:

a body;

piston means positioned within said body and movable from a first position to a second position relative to said body;

means for communicating fluid to said body to move said piston means from said first position, through an intermediate anchored position, to said second position;

anchor means movable by said piston means from a retracted configuration radially outward to a second anchored configuration in which longitudinal movement of said piston means is restrained within the casing;

releasable means for releasably restraining relative motion between said anchor means and said body until said anchor means is moved to said second anchored configuration, said releasable means then releasing said body for longitudinal motion in said casing relative to said piston means and said anchor means; and latching means carried by said body and operatively engageable with a downhole tool so that the tool may be longitudinally moved relative to said piston means and said anchor means as said piston moves into said second position.

2. The apparatus of claim 1, wherein said apparatus further comprises locating means for locating said body adjacent to the downhole tool in a position wherein said latching means is operatively engaged with the tool for movement therewith when said body is moved longitudinally relative to said piston means and said anchor means.

3. The apparatus of claim 2, wherein said locating means includes a length of coil tubing, said body being attached at the free end of said coil tubing.

4. The apparatus of claim 3, wherein said means for communicating fluid includes said coil tubing and wherein said body includes a fluid chamber in communication with the interior of said coil tubing, said piston means being sealingly disposed within said chamber such that fluid pressure from the interior of said coil tubing communicated to said fluid chamber acts on said piston means to move said piston means to an intermediate position between its first and second positions, and thereafter against said body to move said body relative to said piston means and said anchor means until said piston means assumes its second position in said body.

5. The apparatus of claim 2, wherein said locating means includes a wireline, said body being attached at the free end of said wireline.

6. The apparatus of claim 5, wherein said means for communicating fluid includes a length of control tubing and wherein said body includes a fluid chamber in communication with the interior of said control tubing, said piston means being sealingly disposed within said chamber such that fluid pressure from the interior of said control tubing communicated to said fluid chamber acts on said piston means to move said piston means to an immediate position between its first and second positions, and thereafter against said body to move said body relative to said piston means and said anchor means until said piston means assumes its second position in said body.

7. The apparatus of claim 1, wherein said piston means is a sleeve shaped member sealingly disposed in a ring shaped bore in said body.

8. The apparatus of claim 1, wherein said anchor means includes an anchor slip member expandable radially outward by the movement of said piston means against the well casing to restrain longitudinal movement of said piston means in said casing, the movement of said piston means to a position intermediate its first and second positions causing said anchor slip member to ramp over a wedge member and expand radially outward against the well casing to restrain longitudinal movement of said piston means in said casing.

9. The apparatus of claim 1, wherein said releasable means includes at least one shearable element which shears at a predetermined fluid pressure to allow relative motion between said piston means and said body when said anchor means is moved to its second configuration against said casing to restrain longitudinal motion of said piston means in said casing.

10. The apparatus of claim 1, wherein said latching means includes a ratcheting, latchable head, said ratcheting, latchable head having a threaded collet portion which allows said head to ratchet downward over a threaded portion on the tool while preventing ratcheting movement in the opposite direction to allow operative engagement between said head and the tool to permit the tool to be moved longitudinally when said body is moved longitudinally relative to said piston means.

11. The apparatus of claim 10, wherein the tool is a packer.

12. The apparatus of claim 1, wherein said latching means includes a pulling device connected to said body for movement therewith, said pulling device having a J-shaped slot therein.

13. The apparatus of claim 12, wherein the tool is a packer having a lug member thereon engageable in said J-shaped slot to operatively engage the packer with said pulling device to permit the packer to be moved longitudinally when said body is moved longitudinally relative to said piston means when said anchor means is in its second configuration.

14. Hydraulic release apparatus for moving a downhole tool longitudinally in a well casing, comprising:

an elongated, cylindrical body;

a piston movable in said body under the influence of fluid pressure from a first position to a second position in said body;

an anchor slip member expandable radially outward by the movement of said piston against the well casing to restrain longitudinal movement of said piston in said casing, the movement of said piston to a position intermediate its first and second positions causing said anchor slip member to ramp over a wedge member and expand radially outward against the well casing;

releasable means for preventing relative motion between said anchor slip member and said piston until said anchor slip member is moved radially outward against the well casing, said releasable means preventing relative motion between said piston and said body when said anchor slip member is moved outward against the well casing and thereafter releasing at a predetermined pressure to allow said body to move longitudinally in said casing relative to said piston and said anchor slip member, said body being movable longitudinally relative to said piston until said piston assumes its second position in said body; and latching means carried coaxially by said body and operatively engageable with the tool in a manner permitting the tool to be moved longitudinally relative to said piston when said anchor slip member is expanded radially outward against the casing.

15. The apparatus of claim 14, wherein said apparatus further comprises locating means for locating said body adjacent the tool in a position wherein said latching means is operatively engaged with the tool for movement therewith.

16. The apparatus of claim 15, wherein said locating means includes a length of coil tubing, said body being attached at the free end of said coil tubing.

17. The apparatus of claim 15, wherein said locating means includes a wireline, said body being attached at the free end of said wireline.

18. The apparatus of claim 14, wherein said piston is a sleeve shaped member sealingly disposed in a ring shaped bore in said body.

19. The apparatus of claim 14, wherein said latching means includes a ratcheting, latchable head, said ratcheting, latchable head having a threaded collet portion which allows said head to ratchet downward over a threaded portion on the tool while preventing ratcheting movement in the opposite direction to allow operative engagement between said head and the tool to permit the tool to be moved longitudinally when said body is moved longitudinally relative to said piston and said anchor slip member when said anchor slip member is moved to its second configuration against said casing to restrain longitudinal motion of said piston in said casing.

20. The apparatus of claim 19, wherein the tool is a packer.

21. The apparatus of claim 14, wherein said latching means includes a pulling device connected to said body for movement therewith, said pulling device having a J-shaped slot therein.

22. The apparatus of claim 21, wherein the tool is a packer having a lug member thereon engageable in said J-shaped slot to operatively engage the packer with said pulling device to permit the packer to be moved longitudinally when said body is moved longitudinally relative to said piston and said anchor slip member when said anchor slip member is moved to its second configuration against said casing.

23. A method of moving a downhole tool in a well casing, comprising the steps of:

positioning a jack body adjacent the tool and latching the tool to the jack body for longitudinal movement therewith;

applying hydraulic pressure against a piston carried by the jack body to lock the piston against the casing to prevent longitudinal motion of the piston in the casing; and applying farther hydraulic pressure release the jack body for longitudinal motion relative to the locked piston and thereafter moving the jack body longitudinally in the casing relative to the locked piston to move the tool longitudinally in the casing.

* * * * *